US010217419B2

(12) United States Patent
Joo et al.

(10) Patent No.: US 10,217,419 B2
(45) Date of Patent: Feb. 26, 2019

(54) POWER SUPPLY DEVICE, DISPLAY APPARATUS HAVING THE SAME AND METHOD FOR POWER SUPPLY

(71) Applicant: Samsung Electronics Co., Ltd., Suwon-si (KR)

(72) Inventors: Sung-yong Joo, Hwaseong (KR); Jin-hyung Lee, Anyang-si (KR); Youn-seung Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 11 days.

(21) Appl. No.: 15/418,279

(22) Filed: Jan. 27, 2017

(65) Prior Publication Data

US 2017/0309232 A1 Oct. 26, 2017

(30) Foreign Application Priority Data

Apr. 21, 2016 (KR) ..... 10-2016-0048886

(51) Int. Cl.
*G09G 3/36* (2006.01)
*G09G 5/00* (2006.01)
*G09G 3/34* (2006.01)

(52) U.S. Cl.
CPC ... *G09G 3/3406* (2013.01); *G09G 2310/0243* (2013.01); *G09G 2310/0264* (2013.01); *G09G 2320/0626* (2013.01); *G09G 2330/021* (2013.01); *G09G 2330/025* (2013.01)

(58) Field of Classification Search
None
See application file for complete search history.

(56) References Cited

U.S. PATENT DOCUMENTS

| | | | | |
|---|---|---|---|---|
| 5,349,516 | A | 9/1994 | Megeid | |
| 6,437,999 | B1 | 8/2002 | Wittenbreder | |
| 6,950,319 | B2 | 9/2005 | Huber et al. | |
| 7,633,266 | B2 | 12/2009 | Lu et al. | |
| 7,983,063 | B2 | 7/2011 | Lu et al. | |
| 9,077,257 | B2 | 7/2015 | Frium | |
| 2004/0217735 | A1 | 11/2004 | Chitsazan | |
| 2005/0024898 | A1 | 2/2005 | Yang et al. | |
| 2007/0236197 | A1 | 10/2007 | Vo | |
| 2010/0053132 | A1* | 3/2010 | Miyamoto | G01J 1/32 345/207 |
| 2010/0067263 | A1 | 3/2010 | Qian et al. | |
| 2011/0249474 | A1 | 10/2011 | Luo | |
| 2013/0250624 | A1 | 9/2013 | Fornage | |
| 2014/0239930 | A1 | 8/2014 | Wang et al. | |

(Continued)

FOREIGN PATENT DOCUMENTS

KR 20140018801 A 2/2014

*Primary Examiner* — Carl Adams
(74) *Attorney, Agent, or Firm* — Staas & Halsey LLP

(57) ABSTRACT

A display apparatus is disclosed. The display apparatus may include a display configured to display an image using a backlight, an image signal provider configured to provide an image signal to the display and a power supply unit configured to generate first driving power and second driving power using a first converter and a second converter, respectively, and provide the first driving power to the image signal provider and provide the second driving power to the backlight, wherein the power supply unit is configured to control the first converter and the second converter alternately.

20 Claims, 7 Drawing Sheets

(56) References Cited

U.S. PATENT DOCUMENTS

| | | | | |
|---|---|---|---|---|
| 2015/0200623 | A1 | 7/2015 | Kang et al. | |
| 2015/0357926 | A1 | 12/2015 | Fornage et al. | |
| 2016/0300543 | A1* | 10/2016 | Kim | G09G 3/3406 |

* cited by examiner

POWER SUPPLY DEVICE, DISPLAY APPARATUS HAVING THE SAME AND METHOD FOR POWER SUPPLY

CROSS-REFERENCE TO RELATED APPLICATION

This application claims priority from Korean Patent Application No. 10-2016-0048886, filed in the Korean Intellectual Property Office on Apr. 21, 2016, the disclosure of which is incorporated herein by reference in its entirety.

BACKGROUND

1. Field

Aspects of the example embodiments relate to a power supply device, a display apparatus having the same and a method for power supply, and more particularly, to a power supply device configured to control a plurality of converters alternately, a display apparatus having the same and a method for power supply.

2. Description of Related Art

In general, a display apparatus is an apparatus which processes a digital image signal or an analog image signal received from an external source or image signals stored in various formats of a compressed file in an internal storage, and displays the processed signals.

A display apparatus equipped with a backlight has used a power supply device having a plurality of converters in order to supply driving power to a backlight besides driving power for operating a system.

However, a conventional power supply device controls a plurality of converters by using a plurality of control ICs, and accordingly, ripple current increases. In order to prevent this, a large capacitor has been used in a rectification circuit in the conventional power supply device.

SUMMARY

An aspect of example embodiments relates to a power supply device, a display apparatus having the same and a method for power supply.

According to an example embodiment, a display apparatus is provided, the display apparatus including a display configured to display an image using a backlight, an image signal provider configured to provide an image signal to the display and a power supply unit configured to generate first driving power and second driving power using a first converter and a second converter, respectively, and provide the first driving power to the image signal provider and provide the second driving power to the backlight, wherein the power supply unit is configured to control the first converter and the second converter alternately.

The power supply unit may control the first converter and the second converter alternately using different control methods.

The power supply unit is configured to control the first converter by constant voltage control, and control the second converter by constant current control.

The power supply unit may stop generating the second driving power if the backlight is not operated.

The power supply unit may detect input of external AC power, and stop generating the second driving power if no external AC power is detected.

The power supply unit may control the first converter and the second converter alternately by a preset interval.

The power supply unit may include a rectifier configured to rectify external AC power into DC power, a first converter configured to transform the DC power into first driving power and output the first driving power, a second converter configured to transform the DC power into second driving power and output the second driving power and a processor configured to control operations of the first converter and the second converter, and the processor may control the first converter and the second converter alternately.

The processor may control the second converter to stop generating the second driving power if no external AC power is detected.

The power supply unit may further include a sensor configured to sense a level of output load in which the first driving power is inputted, and the processor may control the first converter according to the sensed output load level.

The rectifier may further include an electromagnetic interference (EMI) filter configured to reduce EMI according to the external AC power.

The processor may be implemented as one IC.

According to an example embodiment, a power supply device may include a rectifier configured to rectify external AC power into DC power, a first converter configured to transform the DC power into first driving power and output the first driving power, a second converter configured to transform the DC power into second driving power and output the second driving power and a processor configured to control operations of the first converter and the second converter, and the processor may control the first converter and the second converter alternately.

The processor may control the first converter and the second converter alternately using different control methods.

The processor may control the first converter by constant voltage control, and control the second converter by constant current control.

The processor may control the second converter to stop generating the second driving power according to an external dimming signal.

The processor may detect input of external AC power, and stop generating the second driving power if no external AC power is detected.

The power supply unit may control the first converter and the second converter alternately by a preset interval.

The rectifier may further include an EMI filter configured to reduce EMI according to the external AC power.

The processor may be implemented as one IC.

According to an example embodiment, a power supply method of a power supply device is provided, the method including rectifying external AC power into DC power, transforming the DC power into preset first driving power using a first converter and outputting the first driving power, transforming the DC power into preset second driving power using a second converter and outputting the second driving power and controlling the first converter and the second converter alternately.

DETAILED DESCRIPTION

Hereinafter, example embodiments will be described in more detail with reference to the accompanying drawings.

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known descriptions of well-known functions and constructions may be omitted for clarity and conciseness.

It is to be understood that the singular forms "a," "an," and "the" include plural referents unless the context clearly dictates otherwise. Thus, for example, reference to "a processor" includes reference to one or more of such processors.

In embodiments of the present disclosure, a "module" or a "unit" performs at least one function or operation, and may be implemented in hardware, software, or a combination of hardware and software. In addition, a plurality of 'modules' or a plurality of 'units' may be integrated into at least one module and may be implemented in at least one processor (not illustrated), except for a 'module' or a 'unit' in which they need to be implemented in specific hardware.

Figure 1:
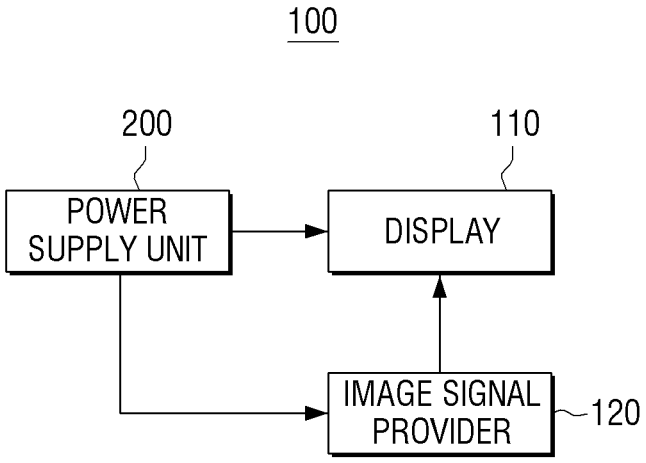
FIG. 1 is a block diagram briefly illustrating a configuration of a display apparatus according to an example embodiment.

FIG. 1 is a block diagram briefly illustrating a configuration of a display apparatus according to an example embodiment.

According to FIG. 1, a display apparatus 100 may include a display 110, an image signal provider 120 and a power supply unit 200.

The display 110 may display an image. The display 110 may be an LCD panel which displays gray gradation by transmitting light generated by the backlight through an LCD or adjusting the amount of light to be transmitted. If the display is operated using the backlight, the display 110 may receive power to be supplied to the backlight through the power supply unit 200 which will be described later, and transmit light emitted by the backlight to the LCD.

The backlight may be configured to emit light to an LCD, and may include a cold cathode fluorescent lamp (CCFL) and a light emitting diode (LED), etc. Hereinafter, the backlight will be illustrated and described as including an LED and an LED operation circuit, but the backlight may also be implemented with other components than an LED.

In the case of using an LED in order to emit light, an LED driver should be equipped in the backlight. The LED driver is a component which provides constant current corresponding to a brightness value to an LED so that a backlight operates in a brightness value corresponding to dimming information provided by the image signal provider 120. The LED driver unit may also not provide constant current according to a dimming signal.

The image signal provider 120 may provide an image signal to the display 110. In specific, the image signal provider 120 may provide image data and/or various image signals for displaying image data in response to image data.

The power supply unit 200 may provide power to each component provided inside the display apparatus 100. In specific, the power supply unit 200 may generate a plurality of driving powers using a plurality of converters which generate different driving powers. For example, according to an example embodiment, the power supply unit 200 may generate first driving power which is provided to components other than the backlight and second driving power which is provided to the backlight. The example embodiment describes only an example of generating two driving powers, but when implementing, it may also be applied to a system which requires more than three driving powers.

The power supply unit 200 may control a plurality of converters alternately. In specific, the power supply unit 200 may control a first converter and a second converter alternately by a preset interval. When controlling, the power supply unit 200 may control the first converter by constant voltage control which allows the first converter to output preset voltage, and control the second converter by constant current control which allows the second converter to output preset current.

The power supply unit 200 may detect input of external AC power, and stop generating the second driving power if no external AC power is detected. The power supply unit 200 may also stop generating the second driving power during an idle mode in which the backlight is not operated. The specific configuration and operation of the power supply unit 220 will be described with reference to FIGS. 3-6.

Figure 2:
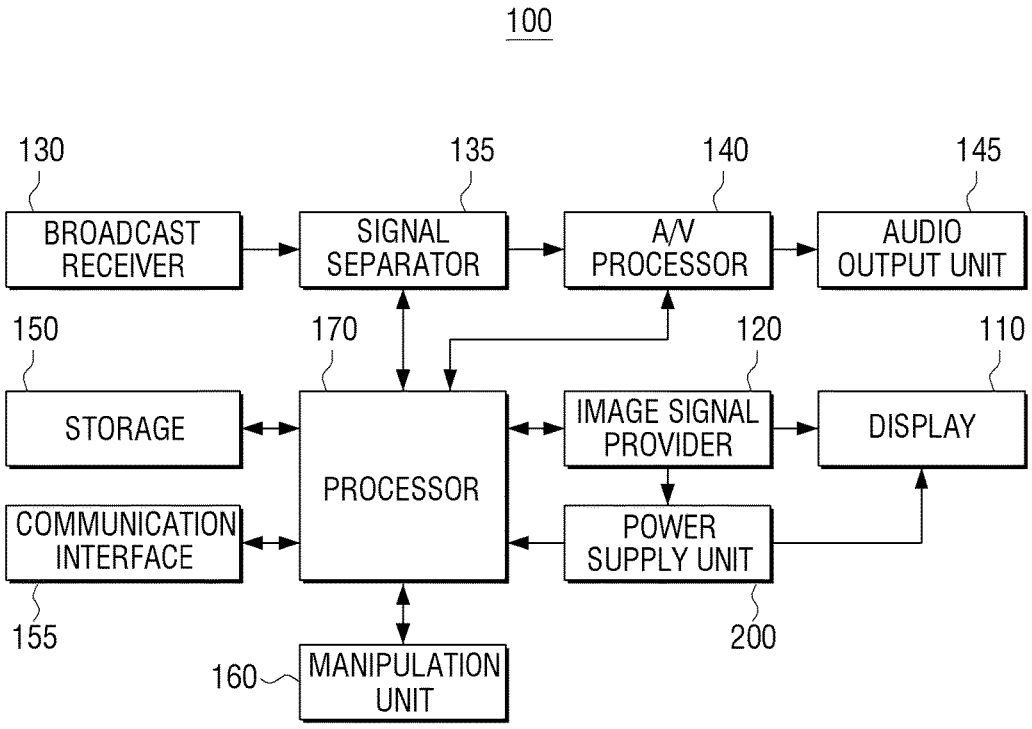
FIG. 2 is a block diagram illustrating a specific configuration of a display apparatus according to an example embodiment.

The configuration of the display apparatus 100 has been briefly described so far, but the display apparatus 100 may include the components illustrated in FIG. 2. Hereinafter, the specific configuration of the display apparatus 100 will be described with reference to FIG. 2.

FIG. 2 is a block diagram illustrating a specific configuration of the display apparatus according to an example embodiment.

Referring to FIG. 2, the display apparatus 100 according to an example embodiment may include the display 110, the image signal provider 120, a broadcast receiver 130, a signal separator 135, an A/V processor 140, an audio output unit 145, a storage 150, a communication interface 155, a manipulation unit 160, a processor 170 and the power supply unit 200.

Since the operations of the display 110 and the power supply unit 200 are illustrated in FIG. 1, the overlapped description will be omitted. Also, in the illustrated example, the power supply unit 200 provides power only to the display 110 and the processor 170, but the power supply unit 200 may also provide power to all the components inside the display apparatus 100, the components which operate using power.

The broadcast receiver 130 may receive a broadcast from a broadcasting station or from a satellite via cable or wirelessly, and demodulate the broadcast.

The signal separator 135 may separate a broadcasting signal into an image signal, an audio signal and an additional information signal. Then, the signal separator 135 may transmit the image signal and the audio signal to the A/V processor 140.

The A/V processor 140 may perform signal processing such as video decoding, video scaling, audio decoding, etc. in response to an image signal and an audio signal inputted from the broadcast receiver 130 and the storage 150. Then, the A/V processor 140 may output the image signal to the image signal provider 120, and output the audio signal to the audio output unit 145.

In the case of storing a received image signal and audio signal in the storage 150, the A/V processor may compress an image and an audio, and output the compressed image and audio to the storage 150.

The audio output unit 145 may change an audio signal output from the A/V processor 140 into a sound, and output the sound through a speaker (not illustrated), or may output the sound through an external output terminal (not illustrated) to a connected external device.

The image signal provider 120 may generate a Graphic User Interface (GUI) which is provided to a user, and add the generated GUI in an image which has been output from the A/V processor 140. Then, the image signal provider 120 may provide to the display 110 an image signal corresponding to the image in which the GUI has been added. The display 110 may accordingly display various information provided by the display apparatus 100 and an image transferred from the image signal provider 120.

In addition, the image signal provider 120 may extract brightness information corresponding to an image signal, and generate a dimming signal corresponding to the extracted brightness information. Then, the image signal provider 120 may provide the generated dimming signal to the display 110. The dimming signal may be an PWM signal for controlling the backlight. It is described in the example embodiment that the image signal provider 120 may generate a dimming signal and provide the signal to the display 110, but when implementing, the display 110 which has received an image signal may also generate a dimming signal and use the signal. Also, it is described that a dimming signal for controlling the backlight may be provided only to the display 110 in the example embodiment, but a dimming signal may also be provided to the power supply unit 200.

The storage 150 may store an image content. For example, the storage 150 may receive from the A/V processor 140 an image content in which an image and an audio are compressed, and output the stored image content to the A/V processor 140 according to control by the processor 170. The storage 150 may be implemented as a hard disk, a non-volatile memory, a volatile memory or the like.

The manipulation unit 160 may be implemented as a touch screen, a touch pad, a key button, a keypad, etc. and provide user manipulation of the display apparatus 100. It is described in the example embodiment that a control command may be received through the manipulation unit 160 equipped in the display apparatus 100, but the manipulation unit 160 may also receive input of user manipulation from an external control device (e.g., a remote controller).

The communication interface 155 may be formed to connect the display apparatus 100 with an external device (not illustrated). The communication interface 155 may be connected not only through local area network (LAN) but also through a universal serial bus (USB).

The processor 170 may control overall operation of the display apparatus 100. For example, the processor 170 may control the image signal provider 120 and the display 110 to display an image according to input of a control command received through the manipulation unit 160.

The processor 170 may determine an operation status of the display apparatus 100. For example, the processor 170 may set a normal mode if an operation of displaying by the display 100 is required, and set an idle mode (or a power saving mode or a standby mode) if the operation of displaying by the display 100 is not required. The idle mode may be a state of waiting for user manipulation (e.g., a power turn-on command), a state of outputting only a voice without displaying on a screen, or a state of IoT communication which is to communicate with another nearby external device.

As described so far, the display apparatus 100 may control a plurality of converters alternately, thereby reducing a peak of input current. Also, as a peak of input current can be lowered, a level of an input capacitor and an EMI filter inside a power supply unit may be designed as small. Moreover, if input AC power is stopped, the display apparatus 100 may stop generating driving power to be supplied to the backlight, and the input capacitor inside a power supply unit may be further reduced.

In the description for FIG. 2, it is described that the described function may be applied only to a display apparatus which receives and displays a broadcast. However, the power supply device described hereinafter may be applied to any electric devices having a display.

Also, although the power supply unit 200 in the example embodiment may be included in the display apparatus 100, the functions of the power supply unit 200 may also be implemented by a separate device. A separate power supply device which performs the same functions as the functions of the power supply unit 200 will be described hereinafter with reference to FIG. 3.

Figure 3:
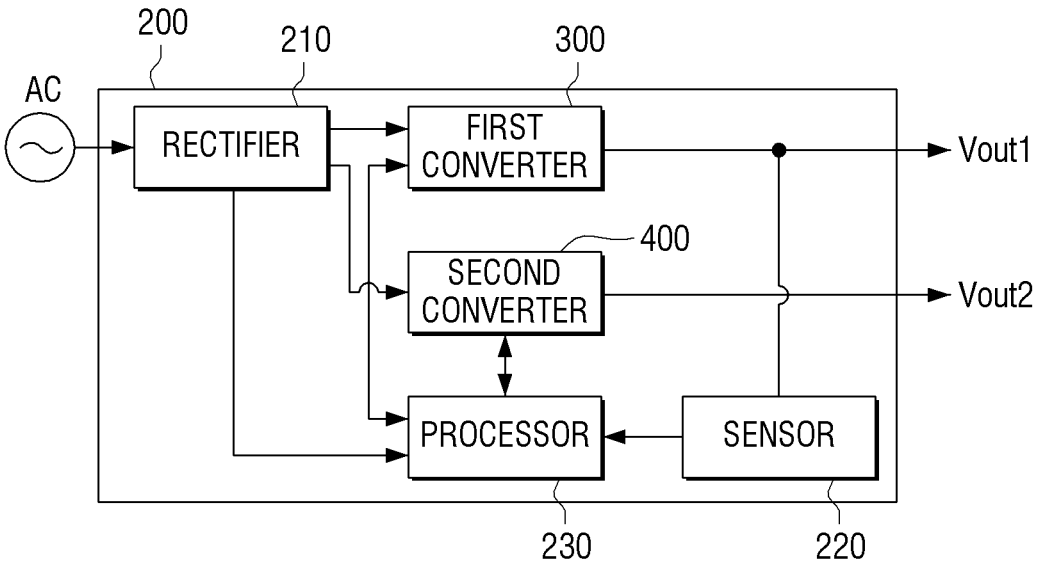
FIG. 3 is a block diagram illustrating a specific configuration of a power supply device according to an example embodiment.

FIG. 3 is a block diagram illustrating a specific configuration of a power supply device according to an example embodiment.

Referring to FIG. 3, the power supply device 200 may include a rectifier 210, a first converter 300, a second converter 400, a sensor 220 and a processor 230.

The rectifier 210 may rectify external AC power into DC power. For example, the rectifier 210 may rectify AC power provided from an external source through a rectification circuit such as a full bridge diode circuit, and the like. The rectifier 210 may be equipped with a smoothing unit (e.g., a capacitor) for smoothing the rectified AC power. Also, the rectifier may equip with an EMI filter for reducing EMI and/or an PFC circuit for compensating a power factor of a system.

The first converter 300 may transform rectified DC power into first driving power and output the first driving power. The first converter 300 may be a converter operated by a control method of constant voltage control (a CV mode) through which a first driving power having a preset level of voltage can be output. The first converter 300 may be implemented as a flyback converter, but not limited thereto, and may also be implemented as various DC/DC converters (e.g., an LLC resonant converter, etc.) which can be operated in a CV mode.

The second converter 400 may transform rectified DC power into second driving power and output the second driving power. The second converter 400 may be a converter operated by a method of constant current control (a CC mode) through which a second driving power having a preset level of current can be output. The second converter 400 may be implemented as a flyback converter, but not limited thereto, and may also be implemented as various DC/DC converters which can be operated in a CC mode.

The sensor 220 may sense a level of output load in which the first driving power is inputted. In specific, the sensor 220 may provide to the processor 230 information of a output load level connected to an output end of the first converter 300 (or a level of current flowing on the output end) using a photo coupler, a flyback circuit and a half bridge circuit and the like.

The processor 230 may control a plurality of converters (300 and 400) alternately. In specific, the processor 230 may control the first converter 300 and the second converter 400 alternately by a preset interval. When controlling, the processor 230 may control the first converter 300 by constant voltage control which allows the first converter 300 to output a preset voltage, and may control the second converter 400 by constant current control which allows the second converter 400 to output a preset current. The processor 230 may be implemented as one IC (e.g., ASIC).

The processor 230 may detect input of external AC power, and stop generating the second driving power if no external AC power is detected. Also, the processor 230 may stop generating the second driving power during an idle mode in which the backlight is not operated.

As described so far, the power supply device 200 according to the example embodiment may control a plurality of converters alternately, thereby reducing a peak of input current. Also, as a peak of input current can be lowered, a level of an input capacitor and an EMI filter inside the rectifier 210 may be designed as small. Moreover, in the case where input AC power is stopped, the display apparatus 100 may stop generating the second driving power to be supplied to the backlight, and an input capacitor inside the rectifier 210 may be further reduced.

Figure 4:
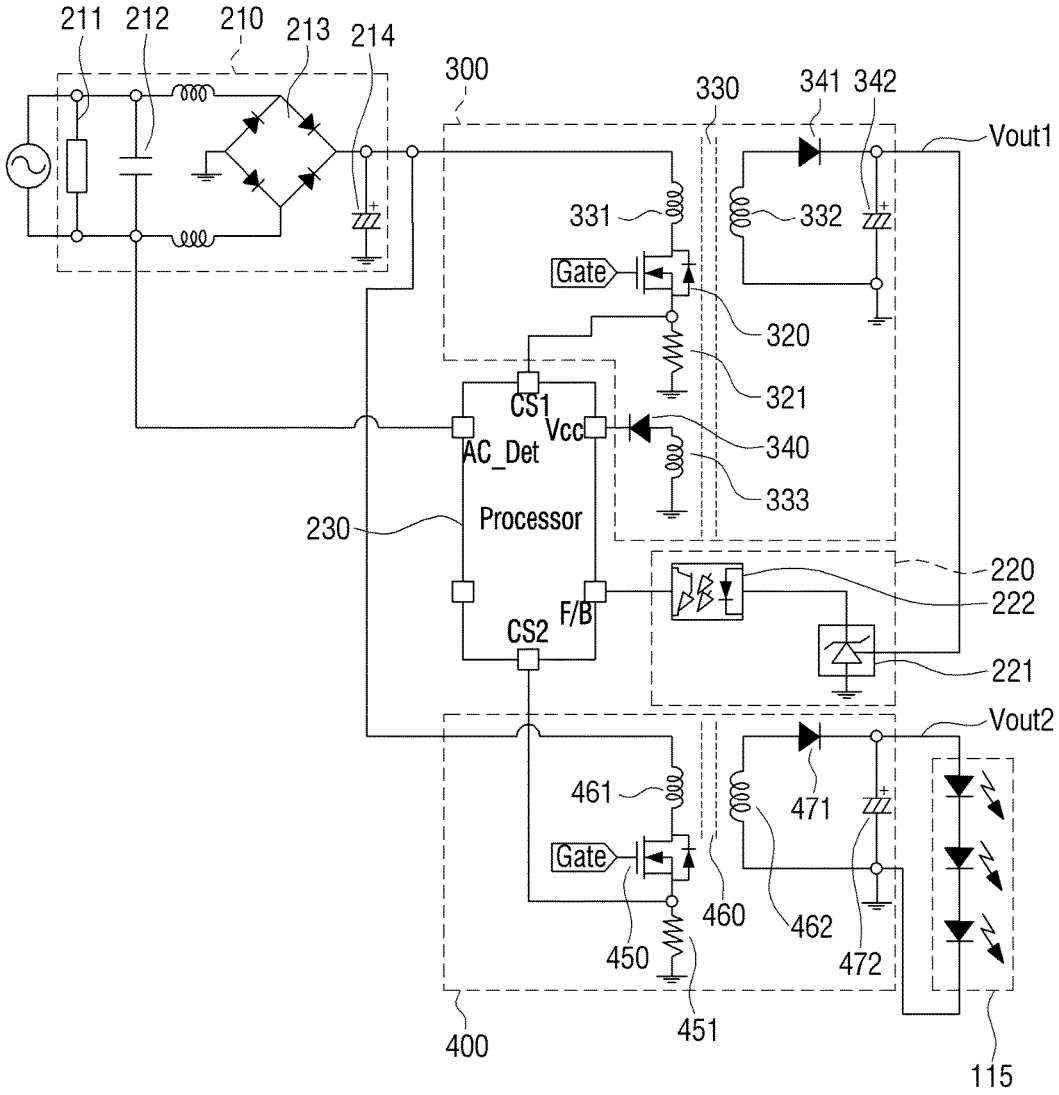
FIG. 4 is a diagram illustrating a power supply circuit according to an example embodiment.

FIG. 4 is a diagram illustrating a power supply circuit according to an example embodiment.

According to FIG. 4, the power supply device 200 may include the rectifier 210, the first converter 300, the second converter 400, the sensor 220 and the processor 230.

The rectifier 210 may rectify external AC power into DC power. The rectifier 210 may include an EMI filter 211, an AC sensor 212, a rectification circuit 213 and a smoothing unit 214.

The EMI filter 211 may reduce EMI noise according to input AC. The EMI filter 211 may be connected to input AC in parallel. The EMI filter may be omitted when implementing.

The AC sensor 212 may sense input of external AC. The AC sensor 212 may be implemented as a capacitor. The AC sensor is implemented as a capacitor in the example embodiment, but the AC sensor 212 may also be implemented by another component which can sense AC.

The rectifier circuit 213 may rectify input AC. The rectifier circuit 213 may be implemented as a full bridge rectifier circuit, but may be implemented another form of a rectifier circuit.

The smoothing unit 214 may smooth rectified AC power. The smoothing unit 214 may be implemented as a capacitor. A peak of input current of the power supply device 200 according to the example embodiment may be more reduced than in the prior art, and thus, capacitance of a capacitor in the smoothing unit 214 may be more reduced than in the prior art.

Also, it has not been illustrated, but the rectifier 210 may further include a PFC circuit for compensating a power factor of the power supply device 200.

The first converter 300 may transform rectified DC power into a first driving power, and output the first device power. The first converter 300 may include a first switch 320, a first resistance 321, a first transformer 330, a first diode 341 and a first capacitor 342.

An end of the first switch 320 may be connected to the other end of a primary winding 331 of the first transformer 330, and the other end of the first switch 320 may be connected to an end of the first resistance 321. The first switch 320 may perform switching according to a control signal of the processor 230.

The first resistance 321 may be a component for sensing a level of current flowing in the primary winding 331. In specific, an end of the first resistance 321 may be connected to the other end of the first switch 320, and the other end of the first resistance 321 may be connected to a primary side ground of the system. An end of the first resistance 321 may be connected to a CS1 end of the processor 230.

The first transformer 330 may include the first winding 331 and a second winding 332 and 333. The first winding 331 and the second winding 332 and 333 may have a preset winding ratio.

An end of the first winding 331 may be connected to an output end of the rectifier 210, and the other end of the first winding 331 may be connected to the first switch 320. An end of the second winding 332 may be connected to an anode of the first diode 341, and the other end of the second winding 332 may be connected to the other end of the first capacitor 342. An end of the second winding 333 may be connected to an anode of the VCC diode 340, and the other end of the second winding 333 may be connected to the primary side ground. The secondary winding 333 may be used for providing power to the processor 230.

The anode of the first diode 341 may be connected to an end of the secondary winding 332 of the first transformer 330, and a cathode of the first diode 341 may be connected to an end of the first capacitor 342.

An end of the first capacitor 342 may be connected to the cathode of the first diode 341, and the other end of the first capacitor 342 may be connected to the other end of the secondary winding 332 of the first transformer 330. Voltages of two ends of the first capacitor 342 may be the first driving voltage.

The second converter 400 may transform rectified DC power into a second driving power and output the second driving power. The second converter 400 may include a second switch 450, a second resistance 451, a second transformer 460, a second diode 471 and a first capacitor 472.

An end of the second switch 450 may be connected to the other end of the primary winding 461 of the second transformer 460, and the other end of the second switch 450 may be connected to an end of the second resistance 451. The second switch 450 may perform switching according to a control signal of the processor 230.

The second resistance 451 may be a component for sensing a level of current flowing in the primary winding 461 of the second transformer 460. In specific, one end of the second resistance 451 may be connected to the other end of the second switch 450, and the other end of the second resistance 451 may be connected to the primary side ground of the system. The first resistance 451 may be connected to a CS2 end of the processor 230.

The second transformer 460 may include the first winding 461 and the second winding 462. The first winding 461 and the second winding 462 may have a preset winding ratio.

An end of the first winding 461 may be connected to an output end of the rectifier 210, and the other end of the first winding 461 may be connected to the second switch 450. An end of the second winding 462 may be connected to an anode of the second diode 471, and the other end of the second winding 462 may be connected to the other end of the second capacitor 472.

The anode of the second diode 471 may be connected to an end of the secondary winding 462 of the second transformer 460, a cathode of the second diode 471 may be connected to an end of the second capacitor 472.

An end of the second capacitor 472 may be connected to the cathode of the secondary diode 471, and the other end of the second capacitor 472 may be connected to the other end of the second winding 462 of the second transformer 460. Voltages of two ends of the second capacitor 472 may be the second driving voltage. The second driving voltage may be provided to the backlight 115.

The sensor 220 may sense a level of output load in which the first driving power is inputted. The sensor 220 may include a diode 221 and a photo coupler 222.

The diode 221 may change flowing current according to an output load level of the first converter 300, and provide the changed current to the photo coupler 222.

The photo coupler 222 may provide to the processor 230 voltage information corresponding to the provided level of current.

The processor 230 may control a plurality of converters 300 and 400 alternately. The processor 230 may be provided with driving power (VCC) through the secondary winding 333 of the first transformer 330 and the diode 340 connected to the secondary winding, and operated by the driving power. The reason why the processor 230 uses the secondary winding of the first transformer 330 is that, if AC power is stopped temporarily or if the backlight is not operated, the second converter cannot perform power conversion as described above.

In addition, the processor 230 may receive input of AC power (AC_Det), current information (CS1) of the primary winding of the first transformer 330, current information (CS2) of the primary winding 461 of the second transformer 462 and information of a level of output load (F/B) in which the first driving current is inputted, and control the two converters 300 and 400 alternately as described above.

As described so far, the power supply device 200 according to the example embodiment may control a plurality of converters alternately, thereby reducing a peak of input current. Also, as the peak of input current can be reduced, a level of an input capacitor inside the rectifier 210 and a level of the EMI filter may be designed as small. Moreover, if input AC power is stopped, the power supply device 200 may stop generating the second driving power to be supplied to the backlight, thereby the level of the input capacitor inside the rectifier 210 may be further reduced.

Figure 5:
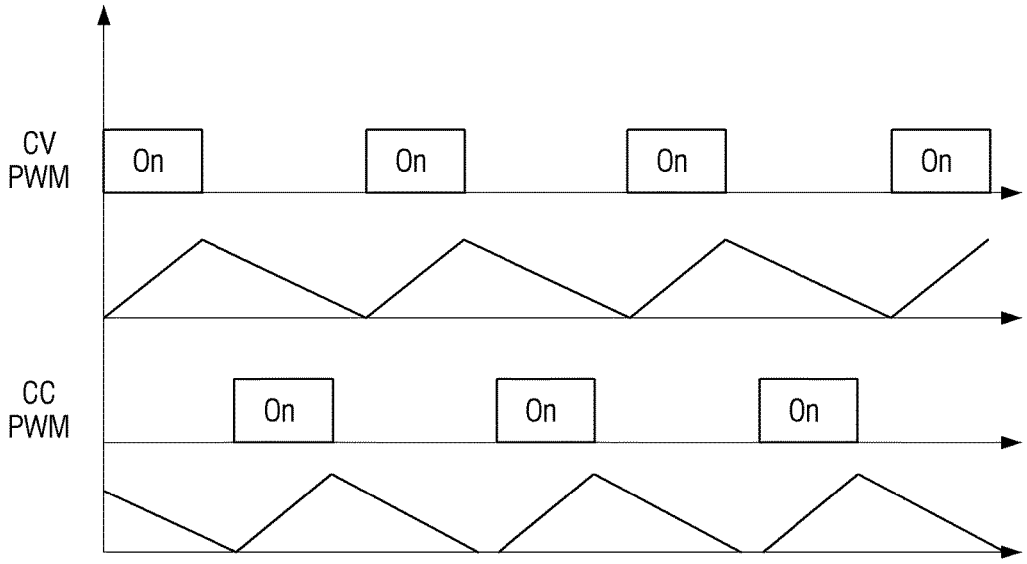
FIG. 5 is a waveform diagram illustrating a control method for controlling a plurality of converters according to an example embodiment.

FIG. 5 is a waveform diagram illustrating a control method for controlling a plurality of converters according to an example embodiment.

According to FIG. 5, within a preset interval, the first converter is controlled by constant voltage control, and then the second converter is controlled by constant current control. As the first converter and the second converter may be controlled alternately, current may be dispersed accordingly.

Figure 6:
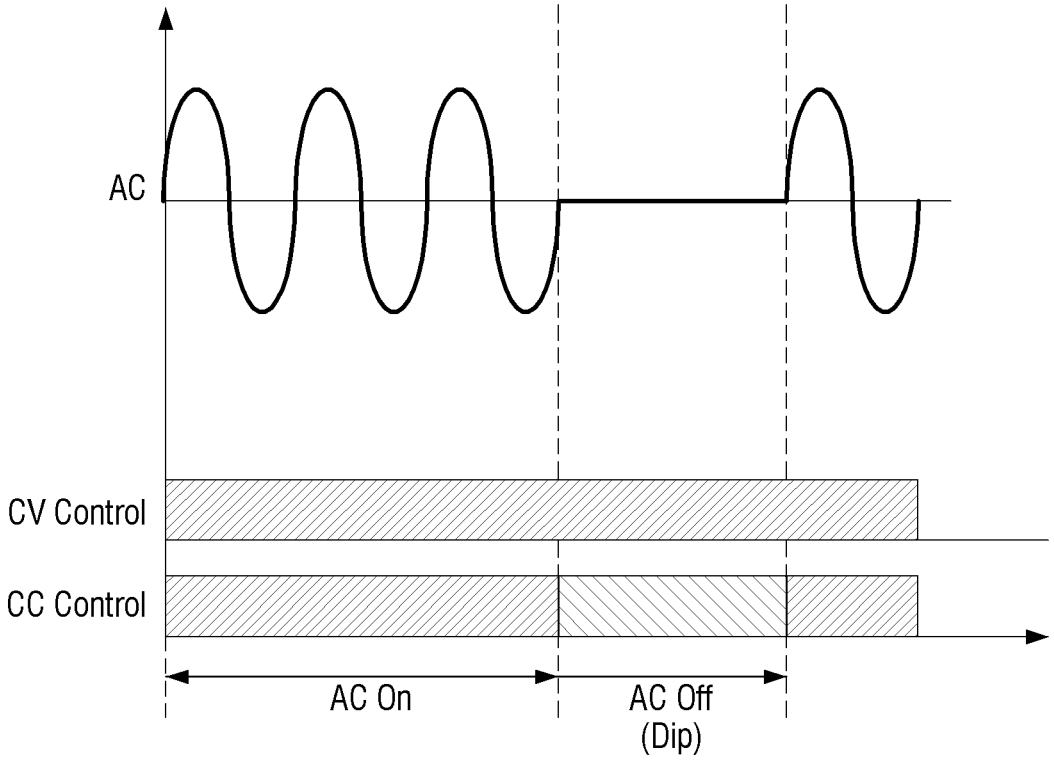
FIG. 6 is waveform diagram illustrating a control operation of a processor according to AC input.

FIG. 6 is a waveform diagram illustrating a control operation of a processor according to input AC.

According to FIG. 6, if external AC power is stopped, the power supply device 200 may control the second converter 400 to stop generating the second driving power from a time point when input of AC power is stopped. In this case, however, the first converter 300 may generate the first driving power. If input of AC power is resumed, the power supply device 200 may control the second converter 400 to start generating the second driving power again.

In the prior art, a large capacitor has been used for storing enough power to be supplied to the first converter 300 and the second converter 400 in order to operate the power supply device 200 stably when AC power is temporarily stopped. However, according to the example embodiment, the operation of the second converter 400 is stopped at the time when AC power is stopped, and only the power for operating the first converter 300 may need to be stored. Thus, the power supply device in the example embodiment may be implemented by a capacitor having lower capacitation than in the prior art.

Figure 7:
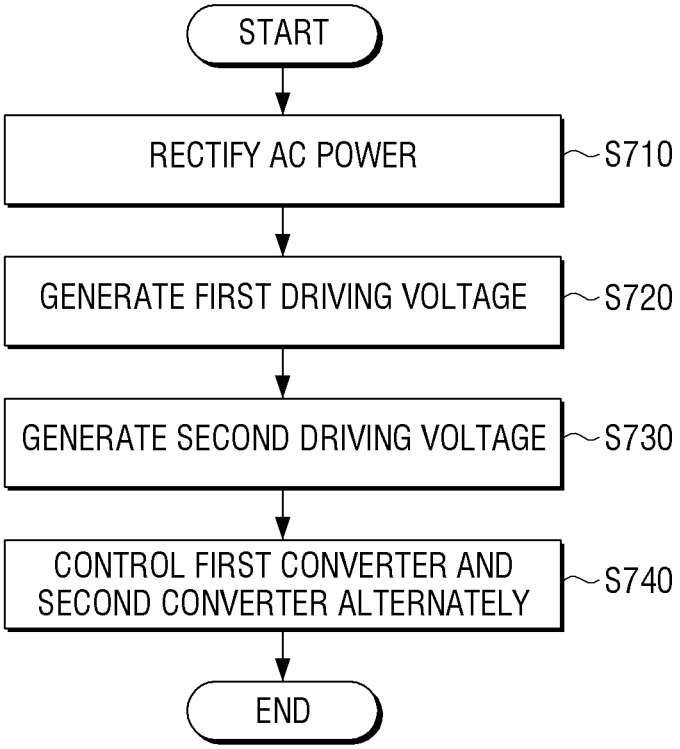
FIG. 7 is a flow chart illustrating a power supply method according to an example embodiment.

FIG. 7 is a flow chart illustrating a method for power supply according to an example embodiment.

According to FIG. 7, external AC power may be rectified into DC power (S710).

The rectified AC power (that is, DC power) may be transformed into a preset first driving power using the first converter, and outputted (S720). A level of the first driving power may be sensed, and the level of power sensed at a first driving time may be controlled to have a preset voltage through constant voltage control.

Also, the rectified AC power (that is, DC power) may be transformed into a preset second driving power, and outputted (S730). Current of the second driving power may be sensed, and the driving current sensed at a second driving time may be controlled to have a preset current value through constant current control.

Then, the first converter and the second converter may be controlled alternately (S740). In specific, the first convert may be controlled by constant voltage control and the second converter is controlled by constant current control alternately.

Therefore, in the power supply method according to the example embodiment, a plurality of converters may be controlled alternately, thereby reducing a peak of input current. Also, as the peak of input current can be reduced, a level of an input capacitor and a level of an EMI filter inside the rectifier 210 can be designed as small. Moreover, in the power supply method according to the example embodiment, generation of the second driving power to be supplied to the backlight may be stopped when input of AC power is stopped, and hence, the level of the input capacitor inside the rectifier 210 may be further reduced. The power supply method as illustrated in FIG. 7 may be implemented by a display apparatus which is configured as in FIG. 1 or in FIG. 2, or by a power supply device configured as in FIG. 3, and may also be implemented by other display apparatuses or power supply devices which are configured as otherwise.

The aforementioned method for power supply may be implemented by a program including an algorithm that can be executed by a computer, and the above-described program may be stored in a non-transitory computer readable medium and provided.

A non-transitory computer readable medium is a medium which does not store data during a short-term such as a register, a cache, a memory and the like, but semi-permanently stores data, and may perform a reading through a device. In specific, the various applications and programs described above may be stored in and provided through a non-temporary reading device such as a CD, a DVD, a hard disk, Blu-Ray, a disk, an USB, a memory card, a ROM and the like.

The foregoing example embodiments and advantages are merely examples and are not to be construed as limiting the exemplary embodiments. The description of the example embodiments is intended to be illustrative, and not to limit the scope of the inventive concept, as defined by the appended claims, and many alternatives, modifications, and variations will be apparent to those skilled in the art.

What is claimed is:

1. A display apparatus comprising:

a display;

a backlight;

an image signal provider to provide an image signal to the display; and a power supply including a first converter and a second converter, wherein the power supply is configured to:

control the first converter and the second converter to generate first driving power having a preset level of voltage using the first converter and second driving power having a preset level of current using the second converter, provide the first driving power to the image signal provider, and provide the second driving power to the backlight, wherein the power supply is further configured to control the first converter and the second converter alternately.

2. The display apparatus of claim 1, wherein the power supply is further configured to control the first converter and the second converter alternately using different control methods.

3. The display apparatus of claim 2, wherein the power supply is further configured to control the first converter by constant voltage control, and control the second converter by constant current control.

4. The display apparatus of claim 1, wherein the power supply is further configured to stop generating the second driving power while the backlight is not operated.

5. The display apparatus of claim 1, wherein the power supply is further configured to:

detect input of external AC power, and stop generating the second driving power, in response to the external AC power not being detected.

6. The display apparatus of claim 1, wherein the power supply is further configured to control the first converter and the second converter alternately according to a preset interval.

7. The display apparatus of claim 1, wherein the power supply further comprises:

a rectifier to rectify external AC power into DC power;

the first converter to transform the DC power into the first driving power and output the first driving power;

the second converter to transform the DC power into the second driving power and output the second driving power; and a processor to control the first converter and the second converter alternately.

8. The display apparatus of claim 7, wherein the processor is further configured to control the second converter to stop generating the second driving power when the external AC power is undetected.

9. The display apparatus of claim 7, wherein:

the power supply further comprises a sensor to sense a level of output load of the first driving power, and the processor is further configured to control the first converter according to the sensed level of output load of the first driving power.

10. The display apparatus of claim 7, wherein the rectifier further comprises an electromagnetic interference (EMI) filter to reduce electromagnetic interference (EMI) according to the external AC power.

11. The display apparatus of claim 7, wherein the processor is configured to be implemented as one IC.

12. A power supply device for a display with a backlight, the power supply device comprising:

a first rectifier to rectify external AC power into DC power;

a first converter to transform the DC power into first driving power having a preset level of voltage and output the first driving power for a image signal provider to provide an image signal to the display;

a second converter to transform the DC power into second driving power having a preset level of current and output the second driving power for the backlight; and a processor to control the first converter and the second converter alternately.

13. The power supply device of claim 12, wherein the processor is further configured to control the first converter and the second converter alternately using different control methods.

14. The power supply device of claim 13, wherein the processor is further configured to control the first converter by constant voltage control, and control the second converter by constant current control.

15. The power supply device of claim 12, wherein the processor is further configured to control the second converter to stop generating the second driving power according to an external dimming signal.

16. The power supply device of claim 12, wherein the processor is further configured to detect input of the external AC power, and to stop generating the second driving power, in response to the external AC power not being detected.

17. The power supply device of claim 12, wherein the processor is further configured to control the first converter and the second converter alternately according to a preset interval.

18. The power supply device of claim 12, wherein the rectifier further comprises an electromagnetic interference (EMI) filter configured to reduce electromagnetic interference (EMI) according to the external AC power.

19. The power supply device of claim 12, wherein the processor is configured to be implemented as one IC.

20. A power supply method of a power supply device for a display with a backlight, the method comprising:

rectifying external AC power into DC power;

transforming the DC power into preset first driving power having a preset level of voltage using a first converter and outputting the first driving power for a image signal provider to provide an image signal to the display;

transforming the DC power into preset second driving power having a preset level of current using a second converter and outputting the second driving power for the backlight; and controlling the first converter and the second converter alternately.

* * * * *